US007286105B2

(12) United States Patent
Akimoto et al.

(10) Patent No.: US 7,286,105 B2
(45) Date of Patent: Oct. 23, 2007

(54) IMAGE DISPLAY

(75) Inventors: Hajime Akimoto, Ome (JP); Kiyoshige Kinugawa, Mutsuzawa (JP)

(73) Assignee: Hitachi, Ltd., Tokyo (JP)

( * ) Notice: Subject to any disclaimer, the term of this patent is extended or adjusted under 35 U.S.C. 154(b) by 235 days.

(21) Appl. No.: 10/339,436

(22) Filed: Jan. 10, 2003

(65) Prior Publication Data

US 2003/0214493 A1 Nov. 20, 2003

(30) Foreign Application Priority Data

May 17, 2002 (JP) ..... 2002-142469

(51) Int. Cl.
*G09G 3/32* (2006.01)

(52) U.S. Cl. ..... 345/82

(58) Field of Classification Search ..... 345/204, 345/60, 66, 76, 82, 690; 315/169.4, 169.1, 315/169.3; 313/512; 257/42
See application file for complete search history.

(56) References Cited

U.S. PATENT DOCUMENTS

| | | | | |
|---|---|---|---|---|
| 5,309,151 | A * | 5/1994 | Aoki | 345/211 |
| 6,337,674 | B1 * | 1/2002 | Kim | 345/66 |
| 6,703,991 | B2 * | 3/2004 | Salters et al. | 345/63 |
| 6,791,516 | B2 * | 9/2004 | Kang | 345/63 |

FOREIGN PATENT DOCUMENTS

| | | |
|---|---|---|
| JP | 08-241048 | 9/1996 |
| JP | 2001-159878 | 6/2001 |

OTHER PUBLICATIONS

"Design of an improved Pixel for a Polysilicon Active-Matrix Organic LED Display" Dawson et al., Technical Digest of SID 98, pp. 11-14 (1998) cited on pp. 22, lines 1-2.
"The Impact of the Transient Response of Organic Light Emitting Diodes on the Design of Active Matrix OLED Displays" Dawson et al., Technical Digest of International Electron Device Meeting 98, pp. 875-878 (1998) cited on p. 31, lines 26-27.

* cited by examiner

*Primary Examiner*—Richard Hjerpe
*Assistant Examiner*—Abbas Abdulselam
(74) *Attorney, Agent, or Firm*—Antonelli, Terry, Stout & Kraus, LLP.

(57) ABSTRACT

The present invention provides an image display capable of performing high-precision multi-gradation display while avoiding problems of a subtle noise and increase in a drive frequency. Display signal data of one frame is constructed by a plurality of sub frames of, for example, four sub frames 1/4 to 4/4. The 1/4 frame is set as an address period of an analog signal, the 2/4 frame is set as an analog gradation display period, the 3/4 frame is set as an address period of a digital signal, and the 4/4 frame is set as a digital gradation light emission period. The image display is constructed in such a manner that, in the analog gradation display period, an OLED device in a pixel emits light of time according to an analog signal voltage stored in a storage capacitor in the pixel by an analog drive signal circuit and, in the digital gradation display period, a binary light emitting operation of light emission and non light emission is performed according to a digital signal voltage stored in the storage capacitor by a digital signal driving circuit.

21 Claims, 14 Drawing Sheets

IMAGE DISPLAY

BACKGROUND OF THE INVENTION

1. Field of the Invention

The present invention-relates to an image display capable of performing multi-gradation display and, more particularly, to an image display suitable for high gradation display.

2. Description of the Related Art

Referring to FIGS. 16 to 18, two conventional techniques will be described hereinbelow.

FIG. 16 is a configuration diagram of a light emitting device using a first conventional technique (hereinbelow, called first conventional technique). Pixels 205 each having an organic electro-luminescent (EL) element 204 as a pixel light emitting material are disposed in a matrix in a display part. The pixels 205 are connected to external drive circuits via gate lines 206, source lines 207, power source lines 208, and the like. In each pixel 205, the source line 207 is connected to the gate of a power TFT 203 and one end of a storage capacitor 202 via a logic TFT (Thin-Film-Transistor) 201, and one end of the power TFT 203 and the other end of the storage capacitor 202 are commonly connected to the power source line 208.

The other end of the power TFT 203 is connected to a common power source terminal via the organic EL element 204. One end of the gate line 206 is connected to a frame scanning circuit 210, and one end of the source line 207 is connected to an analog signal voltage input circuit 209. The logic TFT 201 and the power TFT 203 are formed by using polysilicon TFTs on an $SiO_2$ substrate.

The operation of the first conventional technique with such a configuration will now be described.

When the logic TFT 201 in a predetermined pixel row is opened/closed by the frame scanning circuit 210 via the gate line 206, an analog signal voltage supplied from the analog signal voltage input circuit 209 to the source line 207 is supplied to the gate of the power TFT 203 and the storage capacitor 202 and held for a period of one frame until the next scan writing is performed. The power TFT 203 supplies an analog signal current according to the analog signal voltage to the organic EL element 204. It makes the organic EL element 204 emit light with brightness corresponding to the analog signal voltage.

The first conventional technique is disclosed in detail in, for example, Japanese Unexamined Patent Application No. 8-241048. Although the term "organic electro-luminescent (EL) element" is used as the light emitting element in the above description of the conventional technique in accordance with the term used in the publication in the conventional technique, in recent years, the light emitting element is often called an OLED (Organic Light Emitting Diode) device. In the specification as well, the latter term will be used hereinbelow.

Referring now to FIGS. 17 and 18, another conventional technique will be described.

FIG. 17 is a configuration diagram of a light emitting device using a second conventional technique (hereinbelow, called a second conventional technique). The structure of the second conventional technique is basically similar to the structure described in the first conventional technique except that a digital signal voltage input circuit 211 is provided in place of the analog signal voltage input circuit 209 and a sub frame scanning circuit 212 is provided in place of the frame scanning circuit 210. Only the difference in operations due to the structural differences will be described.

Referring to FIG. 18, the operation of the second conventional technique will be described. As shown in FIG. 18, in the conventional technique, one frame period for displaying information of one frame is divided into a plurality of sub frame periods. Further, the sub frame period is constructed by an address period Ts as a period of writing a display signal to each pixel and each of sustain periods T1 to Tn (to simplify explanation, n=5 in FIG. 18) for performing display with or without light emission in accordance with a written display signal. In the address periods Ts, the drive voltage of the OLED device is at the off level and light is not emitted. Although the operation of writing a display signal to each pixel in each address period is basically similar to that of the first conventional technique, the display signal is not an analog signal voltage but a digital signal voltage of two values of "high level" and "low level".

Therefore, light emission of the OLED device in each of the sustain periods T1 to T5 subsequent to the address periods Ts is also digital light emission of "on" or "off". As shown in FIG. 18, a time weight of the i-th power of 2 is assigned to each of the sustain periods T1 to T5 of the sub frames, so that a weight is assigned to each light emission bit. It enables gray scale display according to each of bits of digital data in the second conventional technique.

An advantage of the conventional technique is that since the power TFT 203 is used as a simple switch, a characteristic variation of the power TFT 203 such as a threshold voltage is not reflected in brightness at the time of light emission. In the conventional technique, consequently, an image can be displayed with small brightness variation and high picture quality. Such a conventional technique is disclosed in, for example, Japanese Unexamined Patent Application No. 2001-159878.

SUMMARY OF THE INVENTION

By extension of the conventional technique, it is difficult to provide an image display realizing multi-gradation display of six bits, eight bits, or the like required for use in a TV or the like in future as described hereinbelow.

In the first conventional technique shown in FIG. 16, the organic EL element 204 as a current driven element is driven by the power TFT 203. The power TFT 203 functions as a current output element which receives a voltage. When a threshold voltage Vth of the power TFT 203 varies, a variation component is added to a signal voltage supplied. Consequently, a fixed brightness deviation occurs in each pixel.

Generally, as compared with a single crystal Si element, a TFT largely varies among elements. Particularly, in the case where a number of TFTs are formed like pixels, it is very difficult to suppress characteristic variations among elements. For example, in the case of a low-temperature polycrystalline silicon TFT, it is known that Vth varies on a volt unit basis. On the other hand, the light emission characteristic of the OLED device is generally sensitive to an input voltage. There is a case that light brightness varies about twice by a difference of the input voltage of 1V. Consequently, such a brightness deviation cannot be allowed in gray scale display. Therefore, in the first conventional technique, it is difficult to realize multi-gradation gray-scale display requiring accurate brightness control.

On the other hand, the second conventional technique described by referring to FIGS. 17 and 18 intends to obtain an accurate brightness control by digitally controlling the OLED device of each pixel. However, to carry out such a digital control by using a number of bits for performing multi-gradation gray-scale display, the number of sub frames has to be increased. For example, in the case of 8-bit display, in addition to eight sustain periods T1 to T8, eight address periods Ts corresponding to eight sub frames are necessary. Due to this, heavy burden is applied on a sub frame scanning circuit 212 and, as a result, it causes an increase in power consumption and cost.

In a display panel of a large size to some extent, the limitations of the time constant of the gate line 206 are seen, so that there is a physical upper limit on the sub frame scanning frequency.

As described above, by the second conventional technique, it is also difficult to increase the number of bits for multi-gradation gray-scale display from the viewpoint of driving.

In short, it is difficult to realize higher precision since the "analog signal" as in the first conventional technique is sensitive to a subtle noise and, on the other hand, since the "digital signal" as in the second conventional technique has to be divided into sub fields, the drive frequency has to be increased, and it becomes difficult to realize higher precision.

An object of the present invention is therefore to provide an image display in which the number of bits for multi-gradation display is increased.

Particularly, an object of the present invention is to provide an image display realizing high-precision multi-gradation display by using both "analog signal" and "digital signal" while avoiding the problem of a subtle noise and the problem of higher drive frequency.

It sounds that both existing "analog" and "digital" signals are simply used. However, the present invention is based on an idea quite different from the conventional idea of simply using both "analog" and "digital" signals. It will be briefly described hereinbelow.

The idea of using both the "digital" and "analog" signals in a conventional electronic circuit is just formation of a "digital circuit" and an "analog circuit" on a single silicon (Si) chip or module.

On the other hand, as long as the inventors herein know, conventional image displays are not based on an idea of realizing higher performance by inputting an "analog signal" to a "digital circuit" or driving an "analog circuit" by a "digital signal" as compared with the case where both of a "digital circuit" and an "analog circuit" are mounted on a single board. The present invention has been achieved by defying common sense and an idea of a different angle, realizing higher-precision and higher-gradation display which is not easily achieved by a single "digital circuit" or "analog circuit", by allowing both an "analog signal" and a "digital signal" to coexist in a single circuit in consideration of a special boundary condition of a display such that a human visual characteristic senses a similar gray scale in each of digital display and analog display.

An example of representative means of the invention is as follows. According to the invention, there is provided an image display including: a display part constructed by a plurality of pixels; a signal line for writing display signal data on each of the pixels; write pixel selecting means for selecting a pixel to which the display signal data supplied to the signal line is written from the plurality of pixels; and signal data generating means for generating the display signal data, wherein the signal data generating means includes multivalue signal data generating means for generating display signal data having a multivalue level of three or more values, the display signal data constructing one frame is constructed by display signal data of a plurality of sub frames supplied to a group of pixels of the plurality of pixels to be displayed in the same frame period, and the display signal data in at least one of the sub frames in one frame has a multivalue level of at least three values, or a multivalue level of three or larger values.

Preferably, the write pixel selecting means is constructed by a polysilicon TFT.

The display signal data in the sub frame may have a multivalue level of three or more values.

DETAILED DESCRIPTION OF THE PREFERRED EMBODIMENTS

Preferred embodiments of an image display according to the present invention will be described in detail hereinbelow with reference to the accompanying drawings.

First Embodiment

With reference to FIGS. 1 to 4, a first embodiment of an image display of the invention will be described. First, by referring to FIG. 1, the general configuration of the embodiment will be stated.

Figure 1:
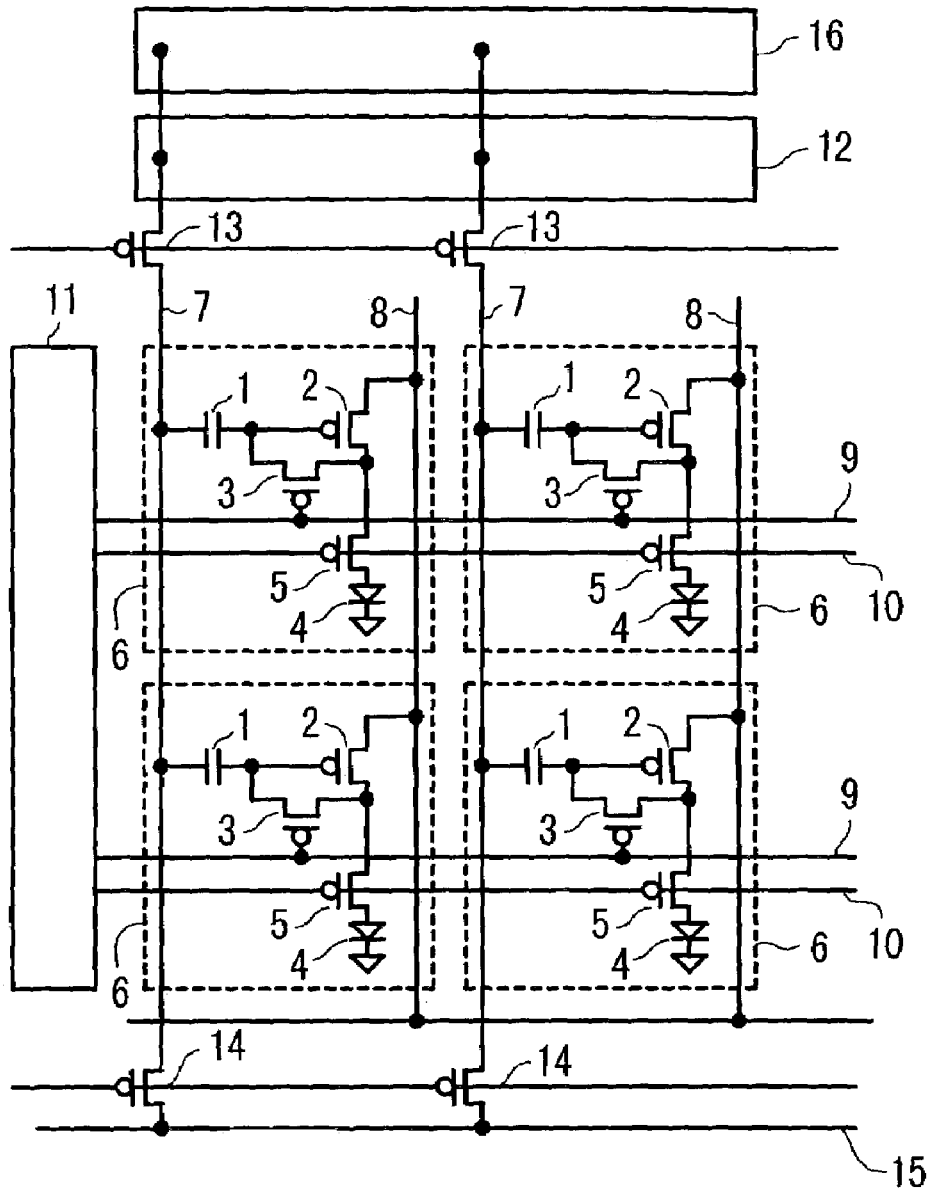
FIG. 1 is a configuration diagram of an OLED display panel as a first embodiment of an image display according to the invention.

FIG. 1 is a configuration diagram of an OLED display panel of the first embodiment. Pixels 6 each having an OLED device 4 as a pixel light emitting material are arranged in a matrix in a display part. Each pixel 6 is connected to predetermined peripheral drive circuits via a writing line 9, an illuminating line 10, a signal line 7, a power source line 8, and the like. The writing line 9 and illuminating line 10 are connected to a pixel selecting circuit 11, and the signal line 7 is connected to an analog signal driving circuit 12 and a digital signal driving circuit 16 via a signal input switch 13 and is further connected to a delta wave input line 15 via a delta wave input switch 14. All of the pixels 6, pixel selecting circuit 11, analog signal driving circuit 12, and digital signal driving circuit 16 are formed on a glass substrate by using polysilicon TFTs.

In each pixel 6, the signal line 7 is connected to the gate of a drive TFT 2 via a storage capacitor 1, a source terminal of the drive TFT 2 is connected to the power source line 8, and a drain terminal of the drive TFT 2 is connected to the OLED device 4 via an illuminating TFT 5. A reset TFT 3 is provided between the gate and drain of the drive TFT 2, the gate of the illuminating TFT Sis connected to the illuminating line 10 and the gate of the reset TFT 3 is connected to the writing line 9. The drive TFT 2 is constructed as a part of an inverter having the OLED device 4 as a load, and the reset TFT 3 can be regarded as a switch for short-circuiting the input/output of the inverter.

Since the methods of fabricating the polysilicon TFT, the OLED device 4 and the like are similar to those generally reported, their description will not be given here. Regarding the OLED device 4, for example, the first and second conventional techniques can be referred to.

As the configuration of the pixel selecting circuit 11 in the embodiment, generally, the circuit configuration which is known as a shift register is used, and reconstruction is possible within a range of general knowledge. As the analog signal driving circuit 12, a general DA (digital-to-analog) converter in a polysilicon TFT panel is used. Alternately, a signal line analog driving circuit in a liquid crystal driver LSI or the like can be used. The digital signal driving circuit 16 is a parallel buffer circuit for buffering 1-bit input data and outputting the data.

In the embodiment, one frame period is divided into four phases. In practice, one frame is constructed by two sub frames each consisting of two phases. For convenience, the phases are named as the 1/4 frame to the 4/4 frame, and operations in the phases will be sequentially described by referring to FIGS. 2A and 2B and FIGS. 3A and 3B.

Figure 2A:
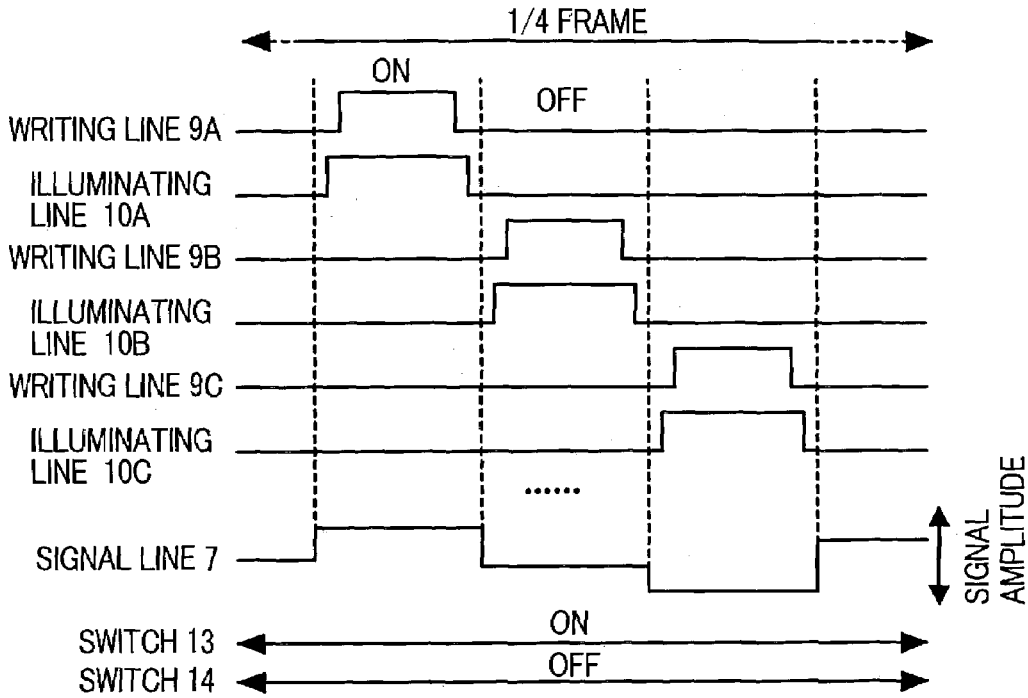
FIG. 2A is a timing chart of a 1/4 frame in a sub frame in the first half of a frame in the first embodiment.
Figure 2B:
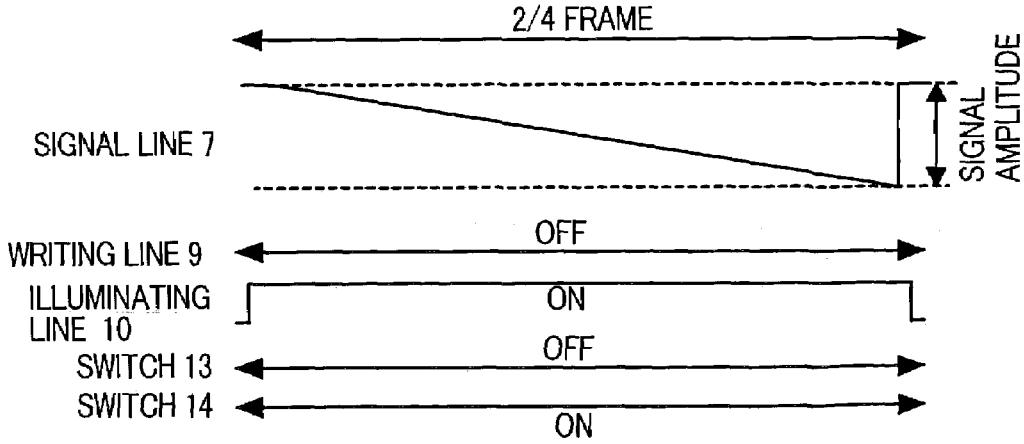
FIG. 2B is a timing chart of a 2/4 frame in the sub frame in the first half of the frame in the first embodiment.

FIGS. 2A and 2B are timing charts showing operations in the 1/4 frame and the 2/4 frame constructing the sub frame in the first half of one frame. In the 1/4 frame period of FIG. 2A, the writing lines 9 and the illuminating lines 10 corresponding to pixel rows are sequentially scanned by the pixel selecting circuit 11. For convenience, it is assumed that, in the timing chart, the wave risen state denotes an "on" state and, the wave fallen state denotes an "off" state. At this time, the signal input switch 13 is on and the delta wave input switch 14 is off. As the pixel selecting circuit 11 selects pixel rows A, B, C, . . . , an analog voltage signal is written by the analog signal output circuit 12 into the selected pixel 6 via the signal line 7. Since it is designed that the analog signal consists of five bits in this case, there are 32 signal voltage levels. Subscripts A, B, and C of the writing lines 9 and illuminating lines 10 correspond to pixel rows in this case and similarly in the following.

In the 2/4 frame period of FIG. 2B, the writing line 9 is set to be always off and the illuminating line 10 is set to be always on by the pixel selecting circuit 11. At this time, the signal input switch 13 is off and the delta wave input switch 14 is on. Consequently, a delta wave as shown in FIG. 2B is input from the delta wave input line 15 to all of pixels via the delta wave input switch 14 and the signal line 7.

A pixel circuit operation of the embodiment in the sub frame will be described in more detail with reference to FIG. 1. A state such that when the reset TFT 3 and illuminating TFT 5 are turned on/off in a state where an analog signal voltage is applied to the signal line 7, a gate voltage of an inverter constructed by the driving TFT 2 and the OLED device 4 becomes a threshold value of inversion of the inverter when the same analog signal voltage is input to the signal line 7 is stored in the storage capacitor 1. This corresponds to writing of the analog signal voltage in the 1/4 frame period. Subsequently, in the 2/4 frame period, when a delta waveform including the written analog signal voltage value is input to the signal line 7, the inverter of each pixel operates so that if the voltage on the signal line 7 is higher than a pre-stored analog signal voltage, a current is not passed to the OLED device 4 and if the voltage of the signal line 7 is lower than the pre-stored analog signal voltage, a current is passed to the OLED device 4. By the operation, the light emission time of the OLED device is controlled by the written analog signal voltage, and variations in the inversion threshold value of the inverter due to the characteristic variations of the driving TFT 2 are also canceled.

The sub frame in the latter half will now be described.

Figure 3A:
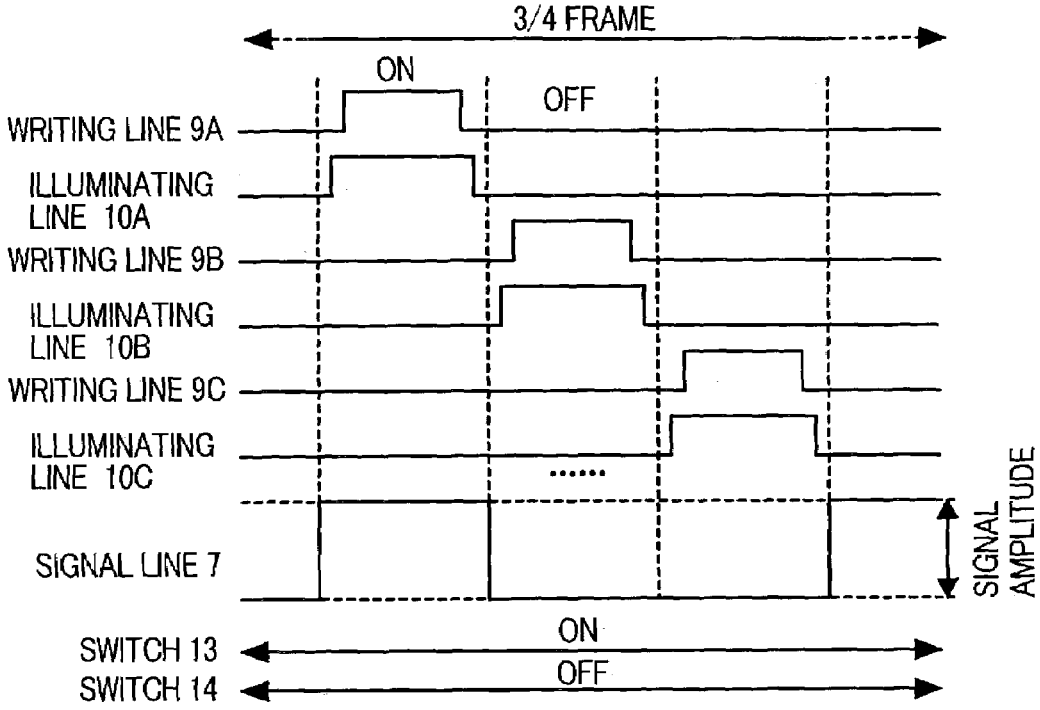
FIG. 3A is a timing chart of a 3/4 frame in a sub frame in the latter half of the frame in the first embodiment.
Figure 3B:
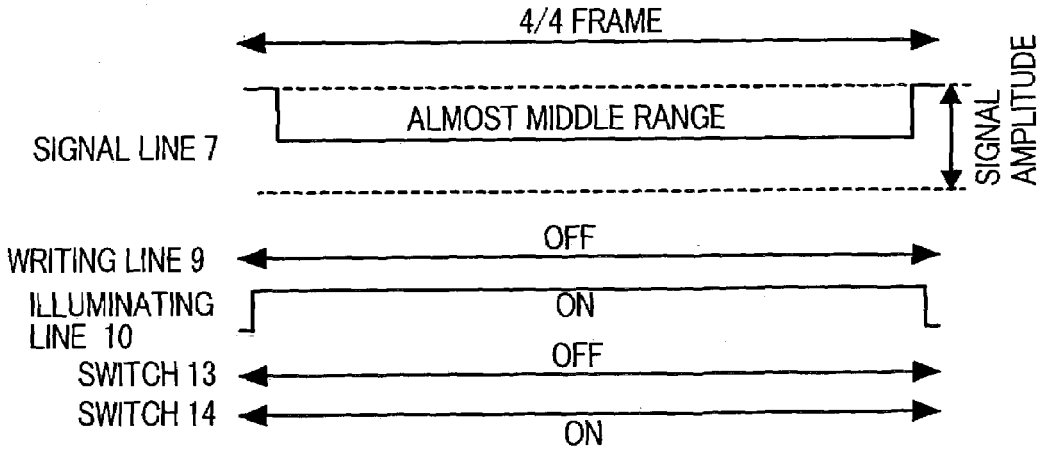
FIG. 3B is a timing chart of a 4/4 frame in the sub frame in the latter half of the frame in the first embodiment.

FIGS. 3A and 3B are timing charts showing the operations of the 3/4 frame and the 4/4 frame constructing the sub frame of the latter half. The operation in the 3/4 frame period in FIG. 3A is basically the same as that in the 1/4 frame. The difference from the operation in the 1/4 frame in this case is that a voltage output to the signal line 7 is not the analog voltage from the analog signal voltage output circuit 12 but is a digital voltage output from the digital signal voltage output circuit 16. As the pixel selecting circuit 11 sequentially selects the pixel rows A, B, C, . . . , a digital voltage signal of one of two values corresponding to "light emission" and "no light emission" is written from the digital signal output circuit 16 to the selected pixel 6 via the signal line 7.

In the 4/4 frame period of FIG. 3B, the writing line 9 is set to be always off and the illuminating line 10 is set to be always on by the pixel selecting circuit 11. At this time, the signal input switch 13 is off and the delta wave input switch 14 is on. Consequently, an intermediate voltage of the digital signal voltage as shown in FIG. 3B is applied from the delta wave input line 15 to all of pixels via the delta wave input switch 14 and the signal line 7.

In this case, an inverter circuit of each pixel (hereinbelow, called a pixel inverter) operates so that when the intermediate voltage of the signal line 7 is higher than a pre-written digital signal voltage, a current is not passed to the OLED device 4 and, when the intermediate voltage is lower than the pre-written digital signal voltage, a current is passed to the OLED device 4. By the operation, light emission of each OLED device 4 is determined by the stored digital signal voltage. Since either the on or off state of the pixel inverter is determined with reliability, an inversion error due to a parasitic effect and the like does not occur, which may occur in the 2/4 frame in which the inversion time of the pixel inverter is controlled. That is, in the 4/4 frame, extremely accurate light emission control can be expected. As a result, in the embodiment, light emission control with precision twice as high as that in the case where driving is made only by analog signal voltages can be realized.

Figure 4:
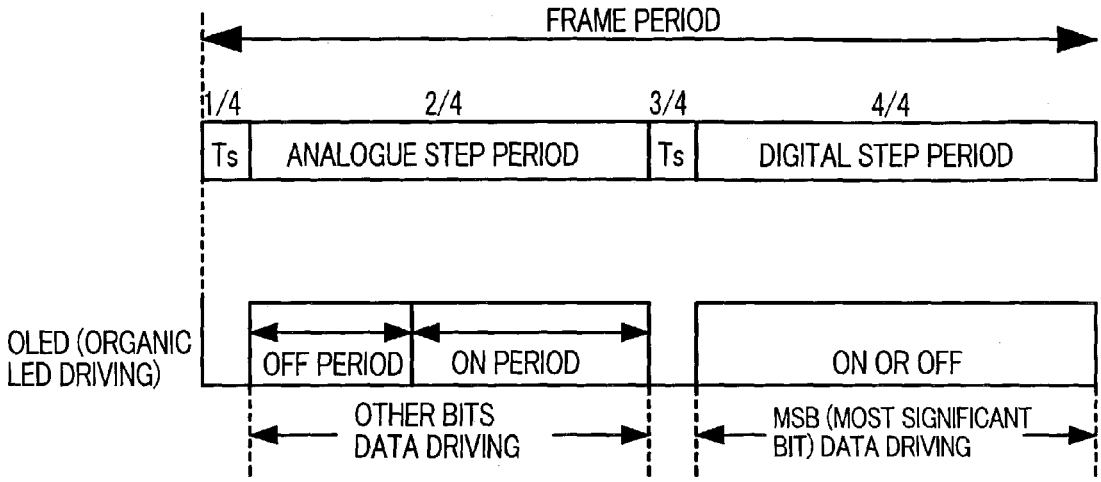
FIG. 4 is a drive sequence diagram of one frame in the first embodiment.

FIG. 4 shows the OLED drive sequence. FIG. 4 shows an address period Ts, analog and digital gradation display periods, and on/off periods of the OLED driving corresponding to the analog and digital gradation display periods. The frame period is constructed by two sub frames of the first half and the latter half sub frames. The first-half sub frame consists of a 1/4 frame as an analog signal voltage address period and a 2/4 frame as an analog gradation display light emission period. The latter-half sub frame consists of a 3/4 frame as a digital signal voltage address period and a 4/4 frame as a digital gradation display light emission period.

The analog signal voltage is 5-bit data of 6-bit data except for the MSB (Most Significant Bit), and the digital signal voltage indicates MSB data. The gradation display in the analog gradation light emission period is controlled by 32 values by modulating light emission time. The gradation in the digital gradation light emission period is binary display of "light emission" and "non light emission". The maximum light emission (ON) period of the analog gradation light emission period is equal to the digital gradation light emission period.

The foregoing embodiment can be variously changed without departing from the spirits of the present invention. For example, although a glass substrate is used as the TFT substrate in the embodiment, in place of the TFT substrate, another transparent insulating substrate such as a quartz substrate or a transparent plastic substrate can be used. When it is arranged to emit light of the OLED device 4 from the top face, an opaque substrate can be also used.

Although only p-channel pixel TFTs are used in the embodiment, by properly changing a drive waveform, n-channel TFTs or CMOS switch can be used. The pixel inverter is not limited to the inverter constructed by the drive TFT 2 and the OLED device 4 but, obviously, a configuration of a CMOS inverter or a constant current source circuit using an n-channel TFT as a load can be also employed.

In the description of the embodiment, the number of pixels, the panel size, and the like are not mentioned purposely for the reason that the invention is not limited by such specifications and formats. Although the display signal voltage is set to have 64 grades (6 bits), the higher gradation is also possible and, on the contrary, the gradation precision can be also easily decreased. Specifically, when k bits from the most significant bit (MSB) out of the m bits are used as binary display signal data for $2^m$ gradation display of m bits, (m-k) bits become a signal used for the analog gradation display. In the embodiment, it corresponds to the case where m=6 and k=1. Therefore, it is sufficient to change m and k in accordance with necessary gradation.

In the embodiment, the peripheral driving circuits which are the pixel selecting circuit 11, analog signal driving circuit 12, and digital signal driving circuit 16 are constructed by low-temperature polysilicon TFT circuits. It is in the scope of the present invention that the peripheral driving circuits or a part of the circuits are constructed by a single-crystal-LSI (Large Scale Integrated circuit). In addition, the delta wave generating circuit or the like can be also constructed by a low-temperature polysilicon TFT circuit.

In the foregoing embodiment, the OLED device 4 is used as a light emitting device. Obviously, the invention can be realized by using a general light emitting device made of other inorganic material in place of the OLED device 4.

The above-described various modifications and the like can be basically similarly applied to not only the foregoing embodiment but also other embodiments described hereinbelow.

Second Embodiment

Figure 5:
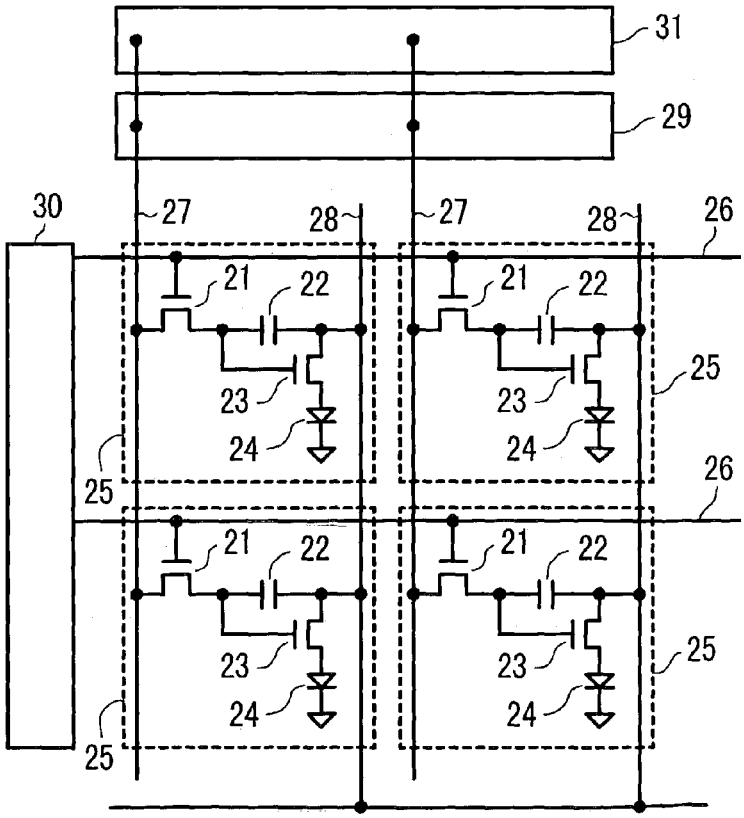
FIG. 5 is a configuration diagram of an OLED display panel as a second embodiment of the image display according to the invention.

A second embodiment of the invention will be described by referring to FIGS. 5 and 6. FIG. 5 is a configuration diagram of an OLED display panel of the second embodiment. Pixels 25 each having an OLED device 24 as a pixel light emitting material are arranged in a matrix in a display part. Each pixel 25 is connected to peripheral drive circuits via a gate line 26, a signal line 27, a power source line 28, and the like.

In each pixel 25, the signal line 27 is connected to the gate of a drive TFT 23 and one end of a storage capacitor 22 via an input TFT 21, and one end of the drive TFT 23 and the other end of the storage capacitor 22 are commonly connected to the power source line 28. The other end of the drive TFT 23 is connected to a common power source terminal via the OLED device 24. On the other hand, one end of the gate lien 26 is connected to a gate scanning circuit 30, and one end of the signal line 27 is connected to an analog signal driving circuit 29 and a digital signal driving circuit 31. The input TFT 21, drive TFT 23, gate scanning circuit 30, analog signal driving circuit 29, and digital signal driving circuit 31 are formed by using polysilicon TFTs on a glass substrate.

The operation of the OLED display panel in the embodiment will be described hereinbelow. In the embodiment, one frame is constructed by two sub frames. For easier understanding, the following description will be given by calling the first sub frame a 1/2 frame and calling the second sub frame a 2/2 frame.

In a writing period of the 1/2 frame, the analog signal driving circuit 29 is activated to output an analog signal voltage and, on the other hand, the digital signal driving circuit 31 is made inactive and an output impedance becomes extremely high. When the gate scanning circuit 30 scans the input TFT 21 in a predetermined pixel row via the gate line 26, an analog signal voltage supplied from the analog signal driving circuit 29 to the signal line 27 is input to the gate of the driving TFT 23 and storage capacitor 22, and held for one sub frame period until the next scanning operation is performed. During the period, the drive TFT 23 passes an analog signal current according to the analog signal voltage to the OLED device 24, and the OLED device 24 emits light with analog brightness corresponding to the analog signal voltage. In this case, the analog signal voltage is a signal of 32 grades corresponding to five bits.

In the 2/2 frame writing period, the digital signal driving circuit 31 is activated to output a digital signal voltage and, on the other hand, the analog signal driving circuit 29 is made inactive, and an output impedance becomes extremely high. When the gate scanning circuit 30 scans again the input TFT 21 in a predetermined pixel row via the gate line 26, the digital signal voltage supplied from the digital signal driving circuit 31 to the signal line 27 is input to the gate of the drive TFT 23 and the storage capacitor 22 and held for one sub frame period until the next scan writing is performed. During the period, the drive TFT 23 passes the digital signal current according to the digital signal to the OLED device 24 and the OLED device 24 emits light or does not emit light in accordance with the digital signal. In this case, the digital signal is an ON or OFF signal corresponding to one bit of the MSB.

In the embodiment as well, the OLED device 24 at the time of digital driving can be turned on or off with reliability. Thus, a light emission brightness error due to a characteristic variation such as a threshold variation in the drive TFT 23, which is concerned at the time of analog driving does not occur. In other words, in the 2/2 frame, extremely accurate light emission control can be expected. As a result, in the embodiment, light emission control with precision twice as high as that in the case of performing driving only by the analog signal voltage driving can be realized.

Figure 6:
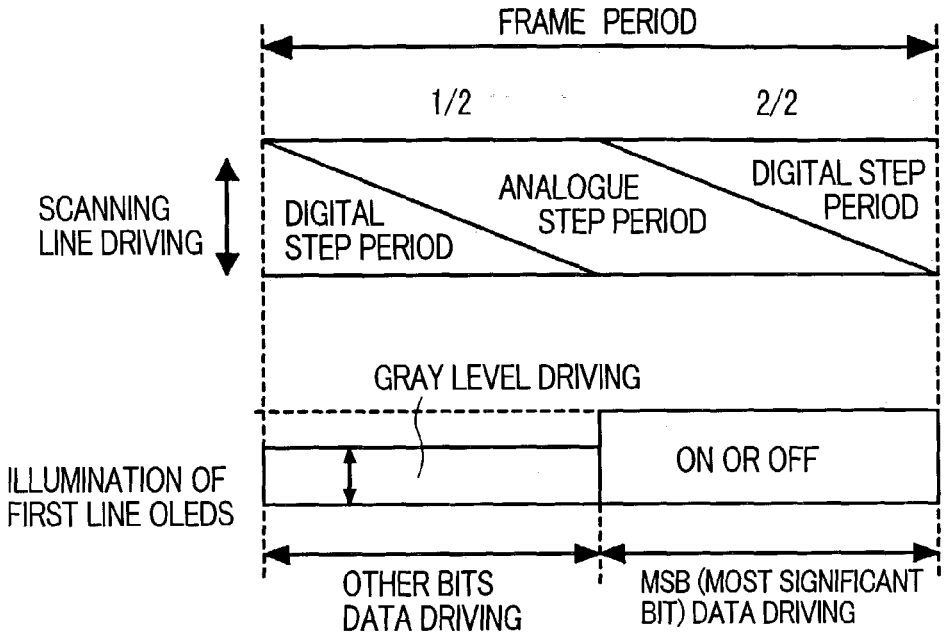
FIG. 6 is a drive sequence diagram of one frame in the second embodiment.

FIG. 6 shows the driving sequence. FIG. 6 shows analog and digital gradation display periods corresponding to scanning lines in one frame, and brightness of OLEDs in the first row. The frame period is constructed by two sub frames of the first-half and latter-half sub frames. The first-half sub frame is a 1/2 frame as an analog signal voltage address period, and the latter-half sub frame is a 2/2 frame as a digital signal voltage address period. The analog signal voltage is 5-bit data except for the MSB of 6-bit data, and the digital signal voltage is MSB data. The gradation display in the analog gradation display light emission period is controlled by modulating the light emission brightness. The grade in the digital gradation display light emission period is indicated by binary data of light emission and non light emission. The analog gradation display light emission period is set to have the same length as the digital gradation display light emission period.

Although the brightness variation at the time of analog gradation light emission is larger than that in the first embodiment, the second embodiment has an advantage such that the pixel configuration is simple.

A method of canceling a threshold voltage variation of the drive TFT 23 by introducing an offset canceling (auto zero) circuit in the analog signal voltage driving period as in the second embodiment is known. Such a method is described in, for example, "Technical digest of SID 98", pp. 11 to 14 (1998) (called a third conventional technique). By combining the offset canceling technique of the third conventional technique to the second embodiment, multi-gradation display with smaller brightness variation can be realized and display with similar high precision while using a TFT of larger characteristic variation can be also realized.

Third Embodiment

Figure 7:
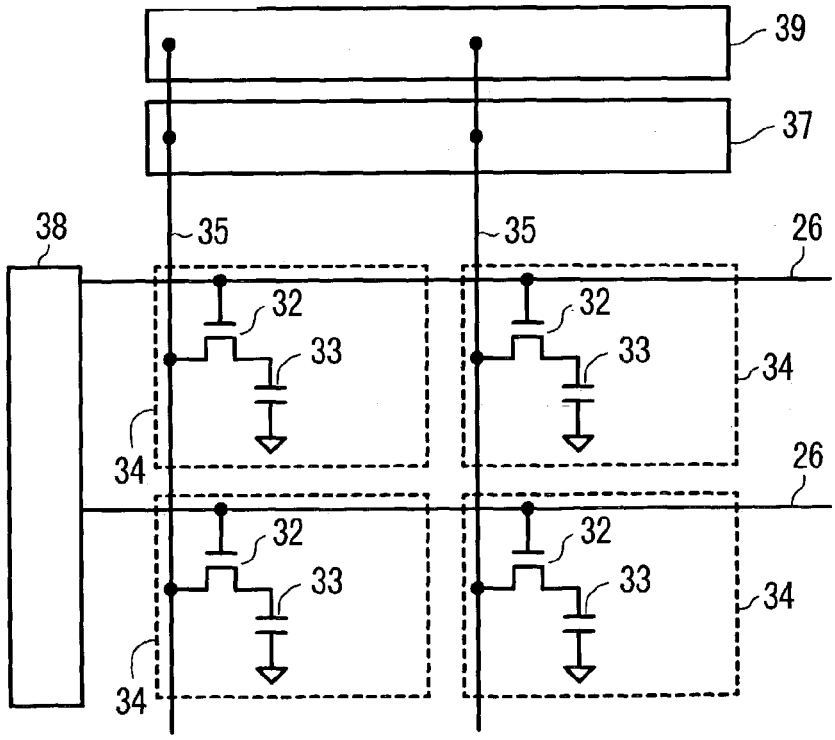
FIG. 7 is a configuration diagram of a liquid crystal display panel as a third embodiment of the image display according to the invention.

A third embodiment of the present invention will be described with reference to FIGS. 7 and 8. FIG. 7 is a configuration diagram of a liquid crystal display panel of the third embodiment. Pixels 34 each having a liquid crystal capacitor 33 as an optical characteristic modulation device are arranged in a matrix in a display part. The pixels 34 are connected to peripheral driving circuits via gate lines 36 and signal lines 35.

In each pixel 34, the signal line 35 is connected to one end of the liquid crystal capacitor 33 via an input TFT 32, and the other end of the liquid crystal capacitor 33 is connected to a common power source terminal. On the other hand, one end of the gate line 36 is connected to a gate scanning circuit 38, and one end of the signal line 35 is connected to an analog signal driving circuit 37 and a digital signal driving circuit 39. The input TFT 32, gate scanning circuit 38, analog signal driving circuit 37, and digital signal driving circuit 39 are formed on a glass substrate by using polysilicon TFTs. In the embodiment, a display panel is constructed in such a manner that a back light is provided on the back face of the glass substrate, and a counter glass substrate on which a counter electrode of the liquid crystal capacitor and a color filter are formed is assembled. The structure is a general one, so that its detailed description will not be given here.

The operation of the third embodiment will be described hereinbelow. In the embodiment, one frame is constructed by three sub frames. For easier understanding, the following description will be given by calling the first sub frame a 1/3 frame, calling the second sub frame a 2/3 frame, and calling the third sub frame a 3/3 frame.

First, in a writing period of the 1/3 frame, the analog signal driving circuit 37 is activated to output an analog signal voltage and, on the other hand, the digital signal driving circuit 39 is made inactive and an output impedance becomes extremely high. When the gate scanning circuit 38 scans the input TFT 32 in a predetermined pixel row via the gate line 36, an analog signal voltage supplied from the analog signal driving circuit 37 to the signal line 35 is input to the liquid crystal capacitor 33 and held for one sub frame period until the next scanning operation is started. During the period, the liquid crystal capacitor 33 applies an analog signal field corresponding to the written analog signal voltage to a liquid crystal layer, and the liquid crystal layer produces a predetermined optical characteristic modulation effect. In this case, the analog signal voltage is a signal of 16 grades corresponding to four bits.

In the 2/3 frame writing period, the digital signal driving circuit 39 is activated to output a digital signal voltage and, on the other hand, the analog signal driving circuit 37 is made inactive,and an output impedance becomes extremely high. When the gate scanning circuit 38 scans again the input TFT 21 in a predetermined pixel row via the gate line 36, the digital signal voltage supplied from the digital signal driving circuit 39 to the signal line 35 is input to the liquid crystal capacitor 33 and held for one sub frame period until the next scan writing is started. During the period, the liquid crystal capacitor 33 applies a digital signal field corresponding to the written digital signal voltage to the liquid crystal layer and the liquid crystal layer shows an optical transmission state or a non-transmission state in accordance with the digital signal. In this case, the digital signal is an ON or OFF signal corresponding to one bit of the MSB.

In the writing period of the 3/3 frame as well, the digital signal driving circuit 39 is activated to output a digital signal voltage and, on the other hand, the analog signal driving circuit 37 is made inactive so that an output impedance becomes extremely high. When the gate scanning circuit 38 scans again the input TFT 21 in a predetermined pixel row via the gate line 36, the digital signal voltage supplied from the digital signal driving circuit 39 to the signal line 35 is input to the liquid crystal capacitor 33 and held for one sub frame period until the next scan writing is started. During the period, the liquid crystal capacitor 33 applies a digital signal field corresponding to the written digital signal voltage to the liquid crystal layer and the liquid crystal layer shows an optical transmission state or a non-transmission state in accordance with the digital signal. In this case, the digital signal is an ON or OFF signal corresponding to the next one bit of the MSB.

In the embodiment as well, the liquid crystal capacitor 33 in the 2/3 and 3/3 frames of digital driving is selected in the on and off state with reliability, so that a modulation brightness error due to a field through charge in the input TFT 32 which is concerned at the time of analog driving does not occur. In other words, in the 2/3 and 3/3 frames, extremely accurate light emission control can be expected. As a result, in the embodiment, light emission control with precision four times as high as that in the case of driving is made only by the analog signal voltage can be realized.

Figure 8:
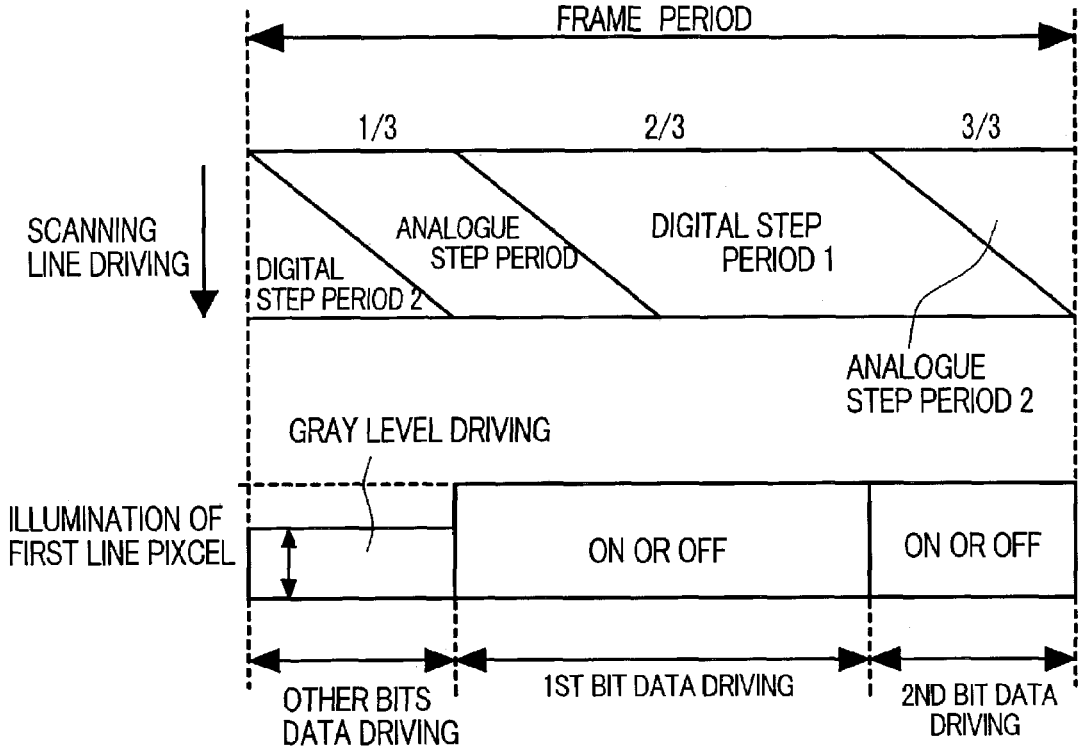
FIG. 8 is a drive sequence diagram of one frame in the third embodiment.

FIG. 8 shows the driving sequence. FIG. 8 shows analog and digital gradation display periods corresponding to scanning line driving in one frame, and illumination of pixels in the first row. The frame period consists of three sub frames. The first sub frame is a 1/3 frame as an analog signal voltage address period, and the following two sub frames are 2/3 and 3/3 frames as a digital signal voltage address period. The analog signal voltage is 4-bit data except for two bits from the MSB out of data of total six bits, and the digital signal voltage is MSB data and 1-bit data next to the MSB.

The gradation display in the analog gradation light emission period is controlled by analog-modulating the optical characteristic of the liquid crystal layer, and the grade in the digital gradation light emission period is indicated by binary data of "light-emission" and "non light emission". The analog gradation display period of the 1/3 frame is set to have the same length as the digital gradation display period 2 of the 3/3 frame, which is the half of the digital gradation display period 1 of the 2/3 frame.

The reason why the digital gradation display period corresponding to the most significant bit is set as the 2/3 frame which is in the middle of the three sub frames with respect to time is as follows. It is known that when the center of gravity of a time base of the light emission (transmission) period fluctuates according to the display grade, a false signal called a false contouring is generated. To lessen the generation, the most significant bit of the longest light emission period is disposed in the center portion of the frame.

In the embodiment, the analog signal consists of four bits and the digital signal consists of two bits. The number of bits can be properly changed according to required specifications. The larger the number of bits of the digital signal is, the higher the gradation precision is. However, increase in the number of sub frames causes increase in a panel drive frequency. Consequently, it is desirable to select the number of bits according to a use. Further, in the case of a liquid crystal panel as in the embodiment, there is generally a problem of speed of response. Increase in the sub frames is limited from the view point of speed of response of the liquid crystal layer.

Obviously, change in the number of bits of a digital signal is not limited to the liquid crystal display panel as in the embodiment but can be also applied to a light emission display panel as described in the foregoing first and second embodiments.

Fourth Embodiment

With reference to FIGS. 9 to 12, a fourth embodiment of the invention will be described. First, by referring to FIG. 9, the general configuration of the fourth embodiment will be stated.

Figure 9:
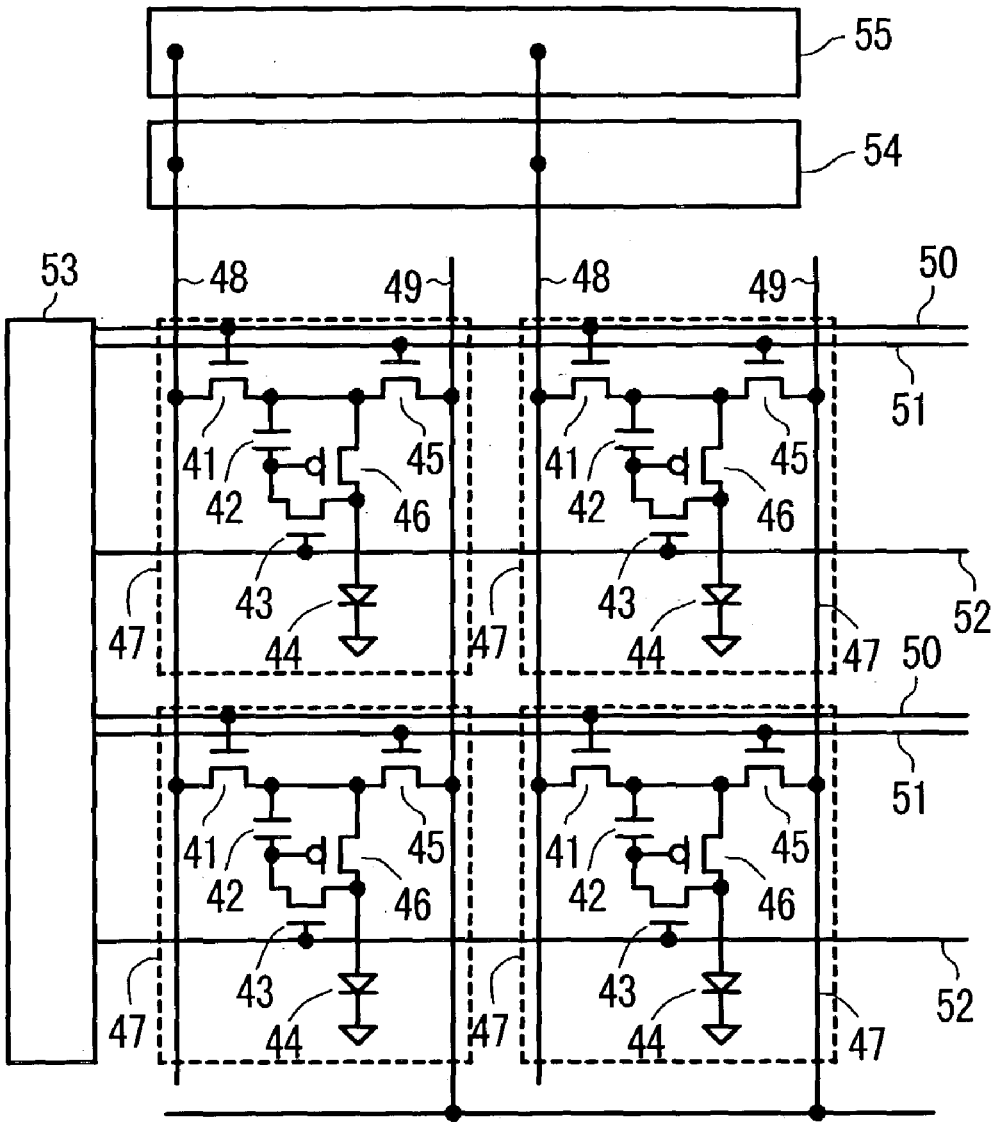
FIG. 9 is a configuration diagram of an OLED display panel in a fourth embodiment of the image display according to the invention.

FIG. 9 is a configuration diagram of an OLED display panel of the fourth embodiment. Pixels 47 each having an OLED device 44 as a pixel light emitting material are arranged in a matrix in a display part. The pixels 47 are connected to predetermined peripheral drive circuits via writing line 50, reset lines 52, display lines 51, signal lines 48, power source lines 49, and the like. The writing lines 50, reset lines 52, and display lines 51 are connected to a pixel selecting circuit 53, and the signal lines 48 are connected to an analog signal driving circuit 54 and a digital signal driving circuit 55. All of the pixels 47, pixel selecting circuit 53, analog signal driving circuit 54, and digital signal driving circuit 55 are formed on a glass substrate by using polysilicon TFTS.

In each pixel 47, the signal line 48 is connected to the gate of a drive TFT 46 via an input TFT 41 and a storage capacitor 42, and a source terminal of the drive TFT 46 is connected to the input TFT 41 and one end of a display TFT 45. Multiple ends of the display TFT 45 are connected to the power source line 49. The drain terminal of the drive TFT 46 is connected to an OLED device 44. A reset TFT 43 is provided between the drain terminal and the gate terminal of the drive TFT 46, the gate of the input TFT 41 is connected to the writing line 50, the gate of the reset TFT 43 is connected to the reset line 52, and the gate of the display TFT 45 is connected to the display line 51.

The basic role of the analog signal driving circuit 54 and that of the digital signal driving circuit 55 are similar to that in the analog signal driving circuit 12 and that in the digital signal driving circuit 16 in the first embodiment except that an output is not a signal voltage but is a signal current in the fourth embodiment. Consequently, in a signal output part of each of the analog signal driving circuit 54 and the digital signal driving circuit 55, a TFT connected to a current source is used.

In the embodiment, one frame period is divided into four phases. In practice, one frame is constructed by two sub frames each consisting of two phases. For convenience, the phases are named as the 1/4 frame to the 4/4 frame, and operations in the phases will be sequentially described by referring to FIGS. 10 and 11.

Figure 10:
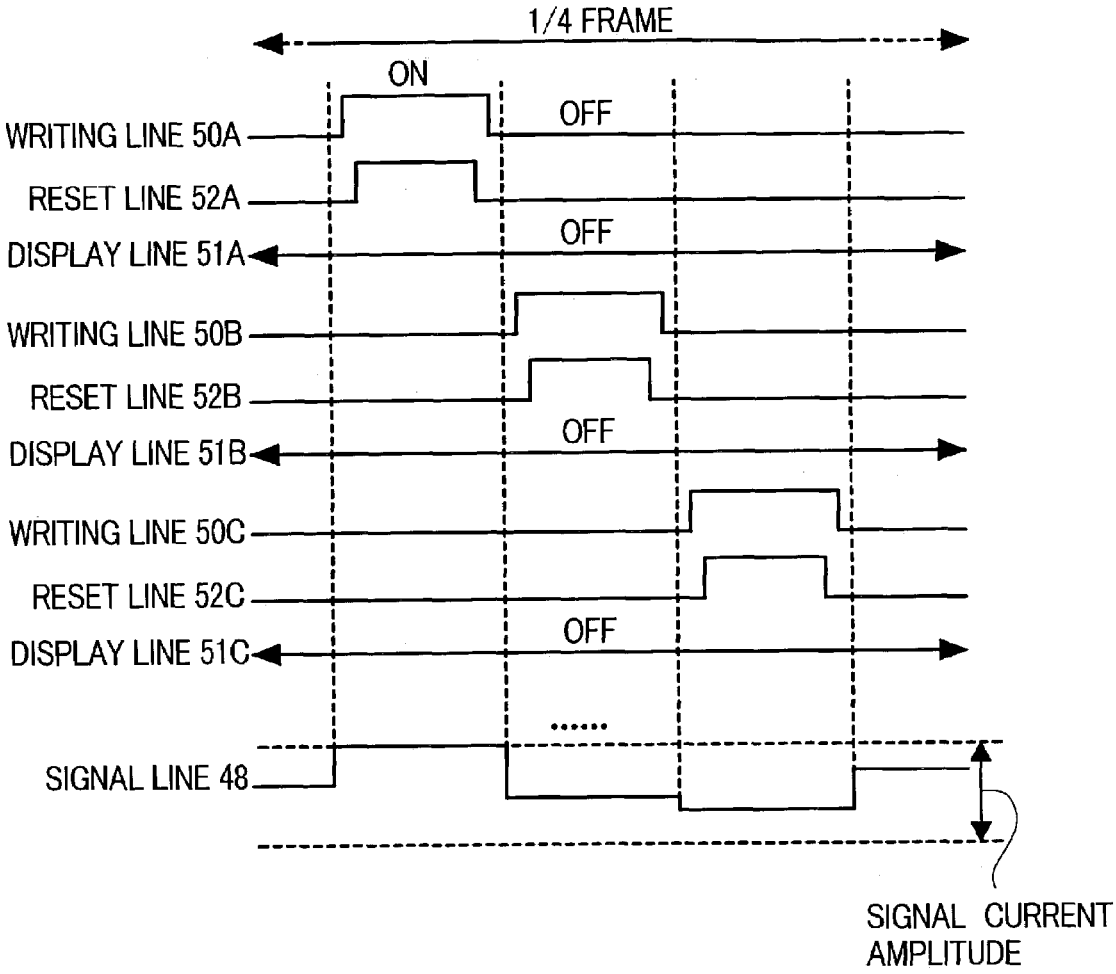
FIG. 10 is a timing chart of a 1/4 frame in a sub frame in the first half of a frame in the fourth embodiment.

FIG. 10 is a timing chart showing operations in the 1/4 frame constructing the sub frame in the first half of one frame. In the 1/4 frame period, the writing lines 50 and the reset lines 52 corresponding to pixel rows are sequentially scanned by the pixel selecting circuit 53. During the period, the display lines 51 are off all the time. As the pixel selecting circuit 53 selects pixel rows A, B, C, . . . , an analog signal current is written by the analog signal output circuit 54 into the selected pixel 47 via the signal line 48. Since it is designed that the analog signal consists of five bits in this case, there are 32 signal current levels. Subsequently, in the 2/4 frame period (not shown), when the display lines 51 are turned on, a light emission power is supplied to each pixel.

A pixel circuit operation in the sub frame will now be described in more detail with reference to FIG. 9. When the input TFT 41 and the reset TFT 43 are turned on/off in a state where an analog signal current is applied to the signal line 48, the same signal current as that supplied to the signal line 48 is passed to the OLED device 44 via the drive TFT 46. Since a voltage across the gate and source of the drive TFT 46 is applied to both ends of the storage capacitor 42, at the time point the reset TFT 43 is turned off, the condition of the voltage across the gate and source is stored in both ends of the storage capacitor 42. This is the writing of the analog signal current in the 1/4 frame period.

Subsequently, in the 2/4 frame period, the display line 51 is turned on and, accordingly, the drive TFT 46 is turned on again. An amount of current passed to the drive TFT 46 at this time is determined by the condition of the voltage across the gate and source preliminarily stored in the storage capacitor 42, so that it is equal to the analog signal current value input to the pixel in the frame 1/4. Therefore, the drive current of the OLED element 44 is controlled by the pre-stored analog signal current, and a light emission current amount is simultaneously controlled.

Figure 11:
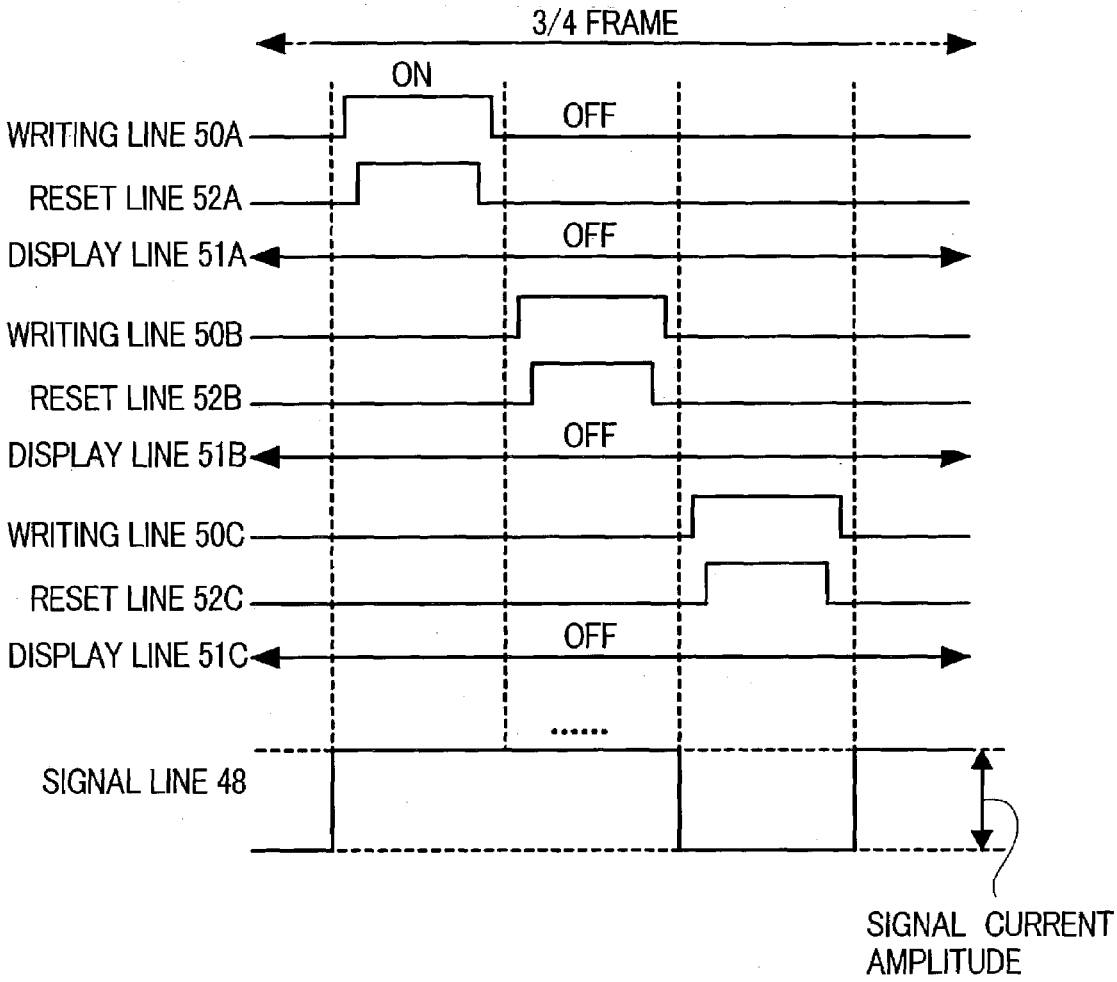
FIG. 11 is a timing chart of a 3/4 frame in the latter half of the frame in the fourth embodiment.

The sub frame in the latter half will now be described. FIG. 11 is a timing chart showing the operations of the 3/4 frame constructing the sub frame of the latter half. The operation in the 3/4 frame period is basically the same as that in the 1/4 frame. The difference from the operation in the 1/4 frame in this case is that a current supplied to the signal line 48 is not an analog current from the analog signal current driving circuit 54 but is a digital current output from the digital signal driving circuit 55. As the pixel selecting circuit 53 sequentially selects the pixel rows A, B, C, . . . , a digital current signal of one of two values corresponding to "light emission" and "no light emission" is written from the digital signal driving circuit 55 to the selected pixel 47 via the signal line 48. In the 4/4 frame period (not shown), the display line 51 is turned on again, thereby supplying the light emission power to each pixel.

Figure 12:
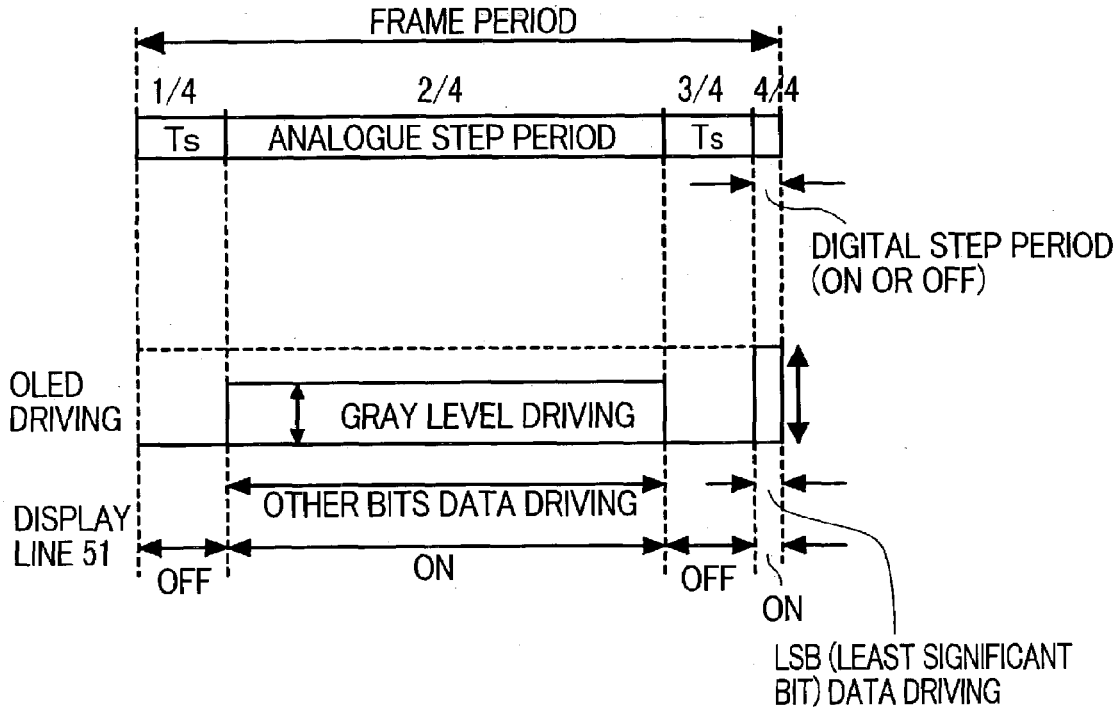
FIG. 12 is a drive sequence diagram of one frame in the fourth embodiment.

FIG. 12 shows the drive sequence. FIG. 12 shows an address period Ts, analog and digital gradation display periods, and on/off periods of the OLED driving and the display line 51 corresponding to the analog and digital gradation display periods. The frame period is constructed by two sub frames of the first half and the latter half sub frames. The first-half sub frame consists of a 1/4 frame as an analog signal current address period and a 2/4 frame as an analog gradation display light emission period. The latter-half sub frame consists of a 3/4 frame as a digital signal current address period and a 4/4 frame as a digital gradation display light emission period. The analog signal current is 5-bit data except for the LSB (Least Significant Bit) out of data of total six bits, and the digital signal voltage indicates LSB data. The gradation display in the analog gradation display light emission period is controlled by 32 values by modulating light emission time. The gradation in the digital gradation display light emission period is binary display of "light emission" and "non light emission". The digital gradation light emission period is a period of 1/64 of the analog gradation light emission period.

The circuit configuration itself of the pixel 47 in the embodiment is an already known technique and its details are described in "Technical Digest of International Electron Device Meeting 98", pp. 875-878 (1998) (hereinbelow, called a fourth conventional technique) and the like. In the case of the fourth conventional technique, the gradation of light emission luminance is controlled only by an analog signal current. The fourth conventional technique has, however, a problem such that when the value of the analog signal current becomes small, a signal current cannot be accurately written into the pixel. When the value of the analog signal current is small, it takes time to charge or discharge parasitic capacitance in a signal line, and an image signal cannot be written at a frame rate at which a moving image can be displayed in reality.

For example, in the case of assuming an OLED panel of about 2 inches, a parasitic capacitance between a writing line and a pixel, which is estimated at least about 4 pF occurs in a signal line in a normal design. When it is assumed that the minimum signal current value is 20 nA and a write voltage is 1V, 200 μsec is necessary to charge/discharge the parasitic capacitance. When the rate is 60 frames per second, the maximum number of pixel rows is only 83.

In contrast, in the embodiment, since the maximum least bit (LSB), that is, the minimum bit is input as the digital current signal, the signal current value is equal to the maximum analog signal current value. Therefore, writing by a substantial minimum signal current value is necessary for the second bit from the LSB, so that the minimum current value is 40 nA in the above example of the numerical values. In the case of the embodiment, therefore, the maximum number of pixel rows can be increased to 166 under the same condition.

Although the digital gradation is applied only to the LSB in the embodiment, by applying the digital gradation to a plurality of bits from the LSB, a display panel of a larger number of pixels, a larger size, or a larger number of grades can be also realized. Specifically, when n bits from the least significant bit (LSB) out of the m bits are used as binary display signal data for $2^m$ gradation display by m bits, (m-n) bits are D/A converted and becomes a signal used for analog gradation display. In the embodiment, it corresponds to the case where m=6 and n=1. Therefore, it is sufficient to change m and n in accordance with necessary gradation. In the case of increasing "n", attention has to be paid since the number of sub frames also increases.

Fifth Embodiment

Figure 13:
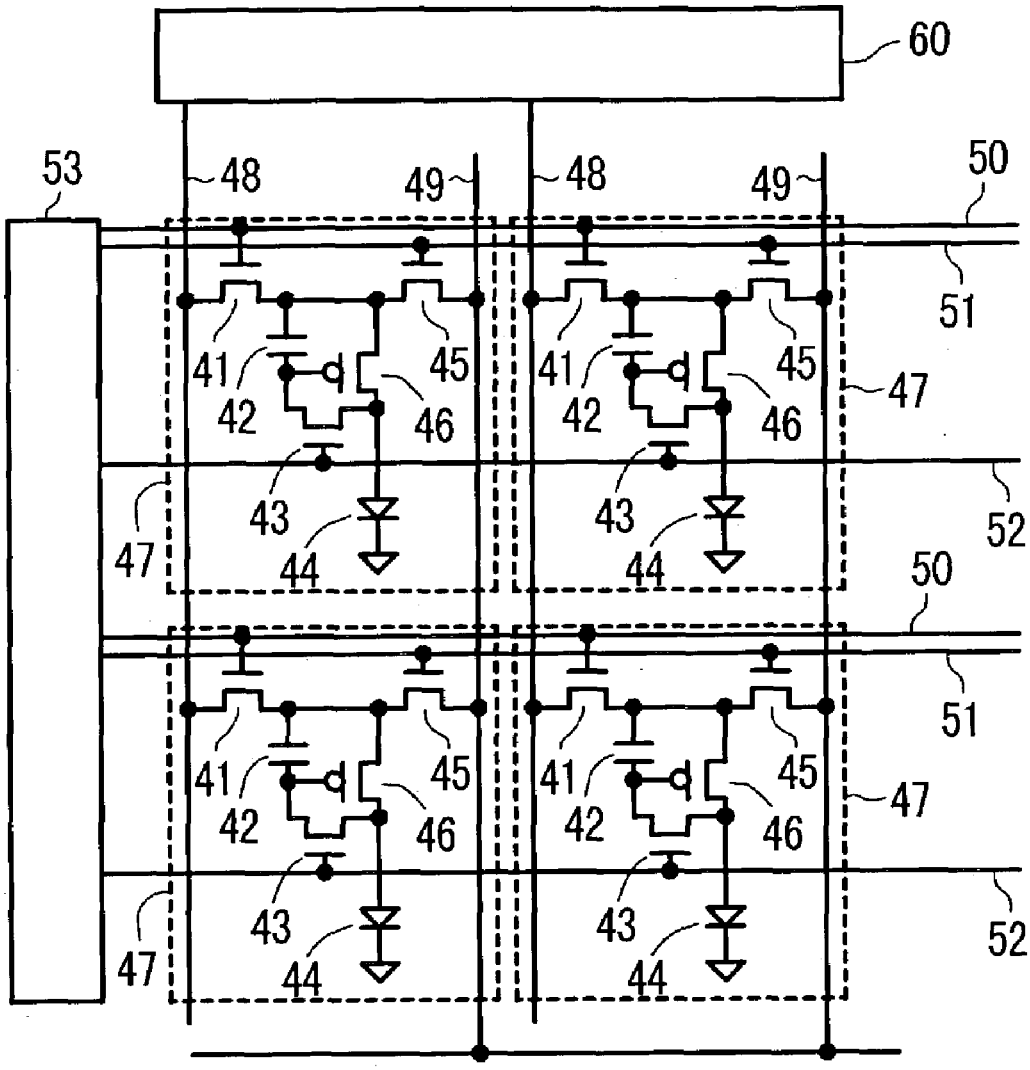
FIG. 13 is a configuration diagram of an OLED display panel as a fifth embodiment of the image display according to the invention.
Figure 14:
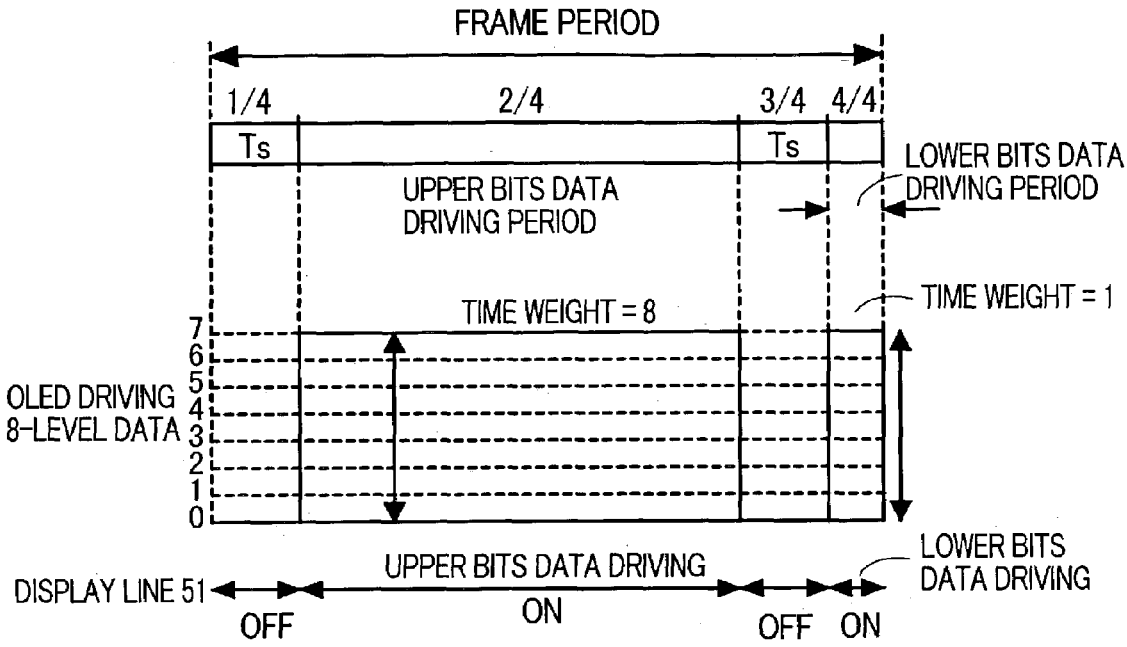
FIG. 14 is a drive sequence diagram of one frame in the fifth embodiment.

With reference to FIGS. 13 and 14, a fifth embodiment of the invention will be described. First, by referring to FIG. 13, the general configuration of the embodiment will be stated.

FIG. 13 is a configuration diagram of an OLED display panel of the fifth embodiment. The pixels 47 each having an OLED device 44 as a pixel light emitting material are arranged in a matrix in a display part. Each pixel 47 is connected to predetermined peripheral drive circuits via writing line 50, reset line 52, display line 51, signal line 48, power source line 49, and the like. The writing lines 50, reset lines 52, and display lines 51 are connected to the pixel selecting circuit 53, and the signal lines 48 are connected to a multivalue signal driving circuit 60. All of the pixels 47, pixel selecting circuit 53, and multivalue signal driving circuit 60 are formed on a glass substrate by using polysilicon TFTS. In each pixel 47, the signal line 48 is connected to the gate of the drive TFT 46 via the input TFT 41 and the storage capacitor 42, and the source terminal of the drive TFT 46 is connected to the input TFT 41 and one end of a display TFT 45.

Multiple ends of the display TFT 45 are connected to the power source line 49. The drain terminal of the drive TFT 46 is connected to the OLED device 44. The reset TFT 43 is provided between the drain terminal and the gate terminal of the drive TFT 46, the gate of the input TFT 41 is connected to the writing line 50, the gate of the reset TFT 43 is connected to the reset line 52, and the gate of the display TFT 45 is connected to the display line 51.

The basic role of the multivalue signal driving circuit 60 is to output signal currents of multiple values, and a TFT connected to a current source is added to a signal output part in a generally known multivalue signal voltage output circuit.

In the embodiment, one frame period is divided into four phases. In practice, one frame is constructed by two sub frames each consisting of two phases. For convenience, the phases are named as the 1/4 frame to the 4/4 frame. Since the operation of the fifth embodiment is similar to that of the fourth embodiment already described by referring to FIGS. 10 and 11 except that the levels of a signal current passed to the signal line 48 are eight grades including 0 in the 1/4 and 3/4 frames, its description will not be repeated.

FIG. 14 shows the drive sequence in the fifth embodiment. FIG. 14 shows the address period Ts, an upper bits data driving period of a time weight of 8, a lower bits digital data driving period of a time weight of 1, and an on/off period of 8-level data OLED driving and the display line 51.

The frame period is constructed by two sub frames of the first half and the latter half sub frames. The first-half sub frame expresses data of upper three bits by light emission brightness of the 8-level OLED device 44, and the latter-half sub frame expresses data of lower three bits by light emission brightness of the 8-level OLED device 44. The first-half sub frame consists of a 1/4 frame as a multivalue signal current address period of the upper three bits and a 2/4 frame as a multi-grade light emission period of upper three bits. The latter-half sub frame consists of a 3/4 frame as a multivalue signal current address period of lower three bits and a 4/4 frame as a multi-grade light emission period of lower three bits.

In this case, the sub frame of the first half can be regarded as upper-bit display in a 2-bit octal number, and the sub frame of the latter half can be regarded as lower-bit display in the 2-bit octal number. Therefore, in the light emission periods of the 2/4 and 4/4 frames, a time weight of 8 times corresponding to the octal number is assigned.

In the embodiment as well, there are an advantage such that the minimum write current value in the multivalue signal current can be a large value, and an advantage such that a signal current can be accurately written into a pixel. In the case of using only a normal analog signal current, for example, signal current writing of 64 grades is necessary. In contrast, in the fifth embodiment, signal current writing of 8 grades is sufficient.

Although display of 64 grades by a eight-bit octal number is realized in the fifth embodiment, the invention is not limited to the specific values. In other words, a combination of y bits in x notation may be employed. For example, 64 gradations can be realized by employing a three-bit tetral number, 256 gradations can be realized by employing a four-bit-tetral number, and so on.

It is unnecessary to use a combination of y bits in an x notation to display all of grades. For example, by employing a three-bit quainary number for 64-grade display, gamma correction is performed on the 64 grades, or by increasing only brightness of the maximum luminance grade to an extreme value, nonlinear brightness display like so-called peak luminance generation can be also realized.

A signal current level to be used can be changed also by display colors of R, G, and B.

Since the embodiment is based on a concept of x notation digital driving, it may be misled that the embodiment is apart from the concept of using both "analog signal" and "digital signal" as the idea of the invention. Description will be further given on this point. Definition of "digital signal" in the conventional image display is clearly "binary digital signal" and the "digital signal" has only two values of "on" and "off". In contrast, the invention is based on the concept of using "multivalued analog signal" as well on the same device. That is, "analog signal" defined in the present invention is not always endless continuous gradations but is "multivalued signal" which even includes "digital signal in x notation". The concept of the embodiment is that "multivalue signal" exists in the concept of a digital signal of a sub frame, so that the embodiment is within the concept of the present invention. It is obvious from the above argument that the concept of displaying only "analog signal" in each of sub frames is included in the present invention.

Sixth Embodiment

Figure 15:
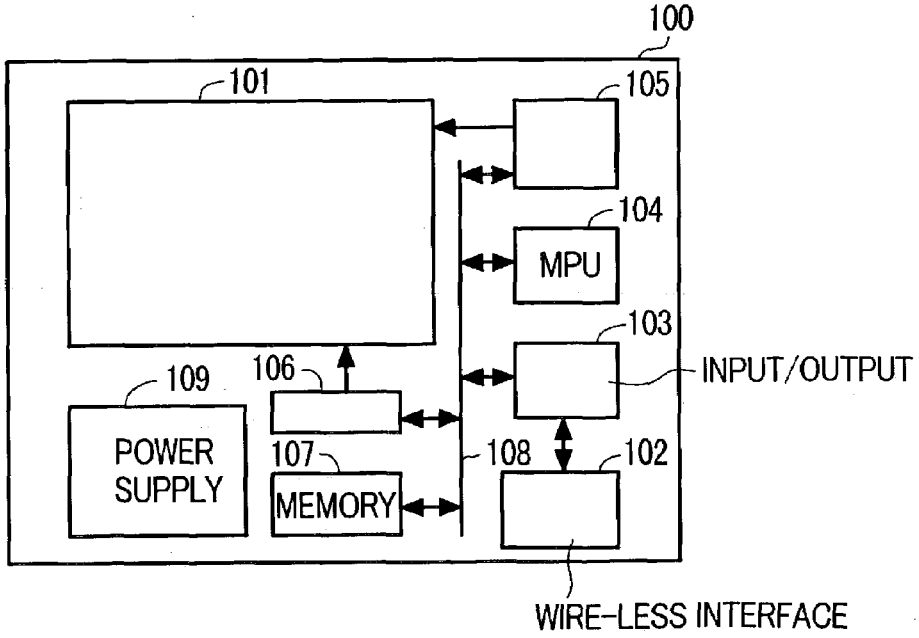
FIG. 15 is a configuration diagram of an image display terminal as a sixth embodiment of the image display according to the invention.
Figure 16:
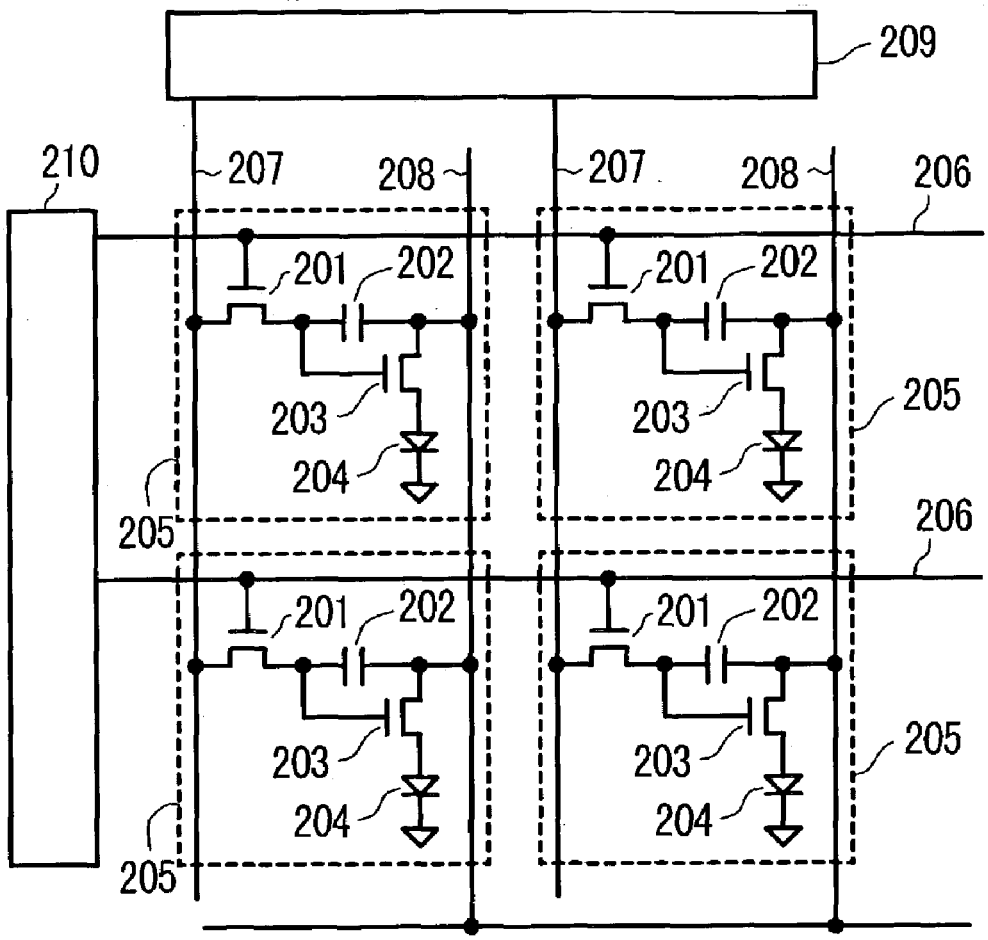
FIG. 16 is a configuration diagram of a light emitting device as a first conventional technique.
Figure 17:
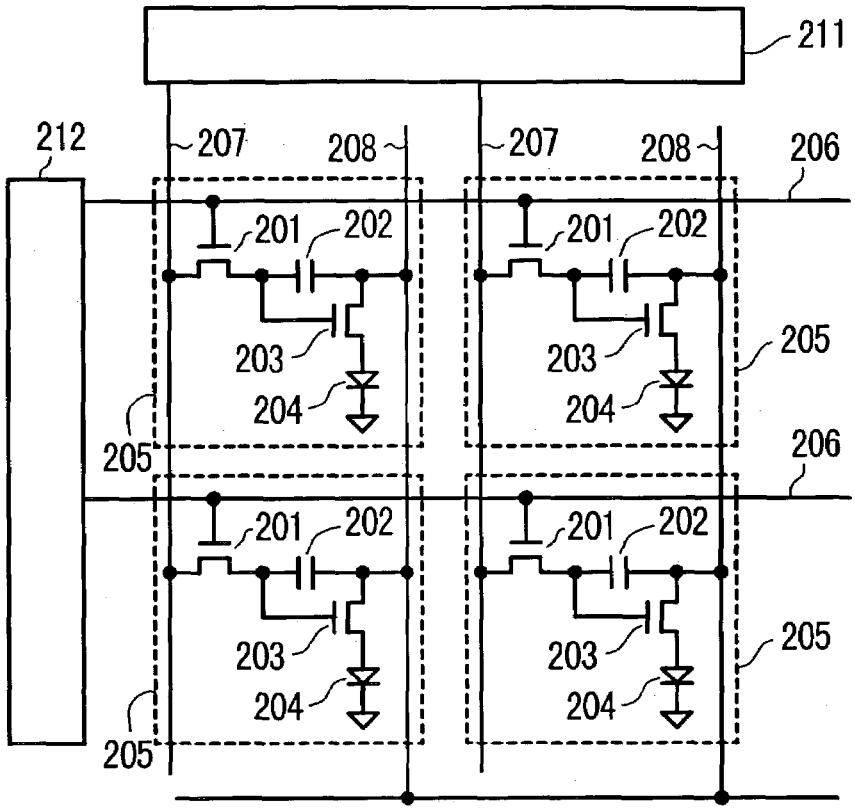
FIG. 17 is a configuration diagram of a light emitting device as a second conventional technique.
Figure 18:
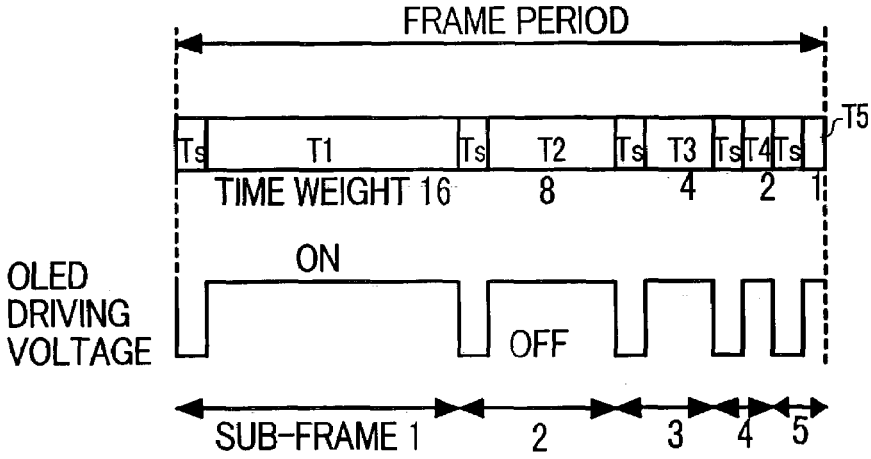
FIG. 18 is an operation sequence diagram of the second conventional technique.

With reference to FIG. 15, a sixth embodiment of the invention will be described. FIG. 15 is a configuration diagram of an image display terminal (PDA: Personal Digital Assistants) 100 as the sixth embodiment.

To a wireless interface (I/F) 102, compressed image data or the like is input as radio data conformed with the standard of a short-range wireless access system from the outside. An output of the wireless I/F 102 is connected to a data bus 108 via an I/O (Input/Output) circuit 103. To the data bus 108, a microprocessor (MPU) 104, a display panel controller 106, a frame memory 107, and the like are also connected.

Further, an output of the display panel controller 106 is input to an OLED display panel 101. The image display terminal 100 is further provided with a delta wave generating circuit 105 and a power supply 109. An output of the delta wave generating circuit 105 is input to the OLED display panel 101. Since the OLED display panel 101 has the same configuration and operation as those in the foregoing first embodiment, its description will not be repeated here.

The operation of the sixth embodiment will be described. First, the wireless I/F 102 receives compressed image data from the outside in accordance with a command and transfers the image data to the microprocessor 104 and the frame memory 107 via the I/O circuit 103. The microprocessor 104 receives a command operation from the user and drives the whole image display terminal 100 as necessary to decode the compressed image data, perform a signal process, and display information. The image data subjected to the signal process is temporarily stored in the frame memory 107.

When the microprocessor 104 gives an instruction of displaying data, in response to the instruction, the image data is supplied from the frame memory 107 to the OLED display panel 101 via the display panel controller 106, and the supplied image data is displayed in a real time manner on the OLED display panel 101. At this time, the display panel controller 106 outputs a predetermined timing pulse necessary to simultaneously display images and, synchronously, the delta wave generating circuit 105 outputs a delta wave shaped pixel drive voltage.

As described in the first embodiment, by using the signals, display data generated from 6-bit image data is displayed in a real time manner on the OLED display panel 101. The power supply 109 which includes a secondary battery supplies power for driving the whole image display terminal 100.

According to the embodiment, the image display terminal 100 capable of performing high-precision multi-gradation display can be provided.

Although the OLED display panel described in the first embodiment is used as an image display device in the sixth embodiment, obviously, various display panels described in the other embodiments of the present invention can be also used.

As obviously understood from the foregoing embodiments, according to the invention, the image display capable of performing high-precision multi-gradation display can be obtained while solving problems of a subtle noise and increase in driving frequency.

What is claimed is:

1. An image display comprising: a display part constructed by a plurality of pixels; a signal line for writing display signal data on each of said pixels; write pixel selecting means for selecting a pixel to which the display signal data supplied to said signal line is written from said plurality of pixels; and signal data generating means for generating said display signal data, wherein said signal data generating means includes multivalue signal data generating means for generating display signal data having a multivalue level of three to eight values, said display signal data constructing one frame is constructed by display signal data of a plurality of sub frames supplied to a group of pixels of said plurality of pixels to be displayed in the same frame period, and said display signal data in at least one of the sub frames in one frame has a multivalue signal voltage level, determined by an intensity axis of three to eight values.

2. The image display according to claim 1, wherein said pixel has therein optical characteristic multivalue modulating means for modulating an optical characteristic in accordance with said display signal data.

3. The image display according to claim 2, wherein said optical characteristic multivalue modulating means is a liquid crystal layer of which optical characteristic is modulated by a voltage applied to a pixel electrode provided in said pixel.

4. The image display according to claim 1, wherein said pixel has therein light emission amount multivalue modulating means for modulating a light emission amount in accordance with said display signal data.

5. The image display according to claim 4, wherein said light emission amount multivalue modulating means is an organic light emission diode device provided in said pixel.

6. The image display according to claim 1, wherein said pixel has therein a capacitor for storing said display signal data for a predetermined period and a switch, and at least said switch is constructed by a polysilicon TFT.

7. The image display according to claim 1, wherein said display signal data has an information amount of m bits, k bits from the most significant bit side are used as display signal data in a binary sub frame, the remaining (m-k) bits are D/A converted and the resultant data is used as display signal data of a sub frame having a multivalue level.

8. The image display according to claim 7, wherein said display signal data is a voltage signal.

9. The image display according to claim 8, wherein said pixel is further provided with a field effect transistor for receiving said display signal data as a gate input signal, and an offset canceling circuit for canceling a threshold variation in the field effect transistor.

10. The image display according to claim 9, wherein said pixel modulates display brightness with time on display signal data having said multivalue level.

11. The image display according to claim 10, wherein said pixel is provided with a light emitting device and an inverter circuit for driving the light emitting device and, in a light emission period corresponding to display signal data having said multivalue level, a delta wave voltage is applied from the outside to said inverter circuit.

12. The image display according to claim 11, wherein said inverter circuit includes a driver transistor and a light emitting device as a load.

13. The image display according to claim 7, wherein said one frame is constructed by two sub frames, said k bit used as binary display signal data is one bit and used as display signal data in said first sub frame, and said remaining (m-k) bits used after being D/A converted are used as display signal data of said second sub frame.

14. The image display according to claim 1, wherein said display signal data has an information amount of m bits, n bits from the least significant bit are used as display signal data in a binary sub frame, the remaining (m-n) bits are D/A converted, and the resultant data is used as display signal data of a sub frame having a multivalue level.

15. The image display according to claim 14, wherein said display signal data is a current signal.

16. The image display according to claim 14, wherein said one frame is constructed by two sub frames, said n bits used as binary display signal data is one bit and used as display signal data in said first sub frame, said remaining (m-n) bits are D/A converted, and the resultant is used as display signal data of said second sub frame.

17. The image display according to claim 1, wherein said display signal data has multi-levels of x values including 0, said one frame is constructed by "y" pieces of sub frames, an i-th power (i=0, 1, . . . , and y-1) of x is assigned to a display period of each pixel in each sub frame, and said display signal data is displayed as y bits in an x notation in one frame.

18. The image display according to claim 17, wherein said display signal data is a current signal.

19. The image display according to claim 17, wherein the number of kinds of display signal data input to said pixel within one frame period is smaller than the y-th power of x.

20. The image display according to claim 17, wherein the number of sub frames in one frame is three, and a sub frame corresponding to the most significant bit in three bits in the x notation is disposed as the second sub frame with respect to time in the three sub frames.

21. An image display comprising: a display part constructed by a plurality of pixels; a signal line for writing display signal data on each of said pixels; write pixel selecting means for selecting a pixel to which said display signal data supplied to the signal line is written from said plurality of pixels; and signal data generating means for generating display signal data by storing data received from the outside and performing an image data process on the data, wherein said signal data generating means includes multivalue signal data generating means for generating display signal data having a multivalue level of three to eight values, said display signal data constructing one frame is constructed by display signal data of a plurality of sub frames supplied to a group of pixels of said plurality of pixels to be displayed in the same frame period, and said display signal data in at least one of sub frames in one frame has a multivalue level of three to eight values, determined by an intensity axis, of three or larger values.

* * * * *